US005205144A

United States Patent [19]

Montano

[11] Patent Number: 5,205,144

[45] Date of Patent: Apr. 27, 1993

[54] DOOR LOCK MESSAGE HOLDER

[76] Inventor: Robert M. Montano, 2474 Rockville Centre Parkway, Oceanside, N.Y. 11572

[21] Appl. No.: 593,945

[22] Filed: Oct. 9, 1990

[51] Int. Cl.[5] ..... E05B 7/14

[52] U.S. Cl. ..... 70/455

[58] Field of Search ..... 70/456 B, 455, 389, 70/390, 456 R

[56] References Cited

U.S. PATENT DOCUMENTS

| | | | |
|---|---|---|---|
| 1,752,380 | 4/1930 | Gress | 70/456 B |
| 3,421,350 | 1/1969 | Shanek | 70/455 |
| 3,475,934 | 11/1969 | Reisner | 70/455 |
| 4,118,962 | 10/1978 | Block | 70/455 |
| 4,676,084 | 6/1987 | Signorelli | 70/440 |

*Primary Examiner*—Renee S. Luebke

*Attorney, Agent, or Firm*—Abdallah & Muckelroy

[57] ABSTRACT

A door lock message holder is disclosed which includes a holder head having alternative means to securely attach a message to a door, and a message board attached to the holder head. The holder head includes door lock keyhole attachment means and door lock body attachment means.

5 Claims, 2 Drawing Sheets

DOOR LOCK MESSAGE HOLDER

BACKGROUND OF THE INVENTION

The present invention generally relates to message pads and like devices. More particularly, this invention relates to secure means for leaving a message in a conspicuous location at a door.

Oftentimes, particularly in an emergency situation, it is desired to leave a written message for a person who cannot be located. A message on a piece of paper left tacked to a door or under a windshield wiper of a car may become lost or go unnoticed for hours. Thus there is a need for means to leave a written message that is secured in place and that is conspicuous to the intended recipient.

SUMMARY OF THE INVENTION

The present invention discloses a message holder that can be securely attached to a key-operated door lock. The door lock message holder of the present invention comprises a holder head having means to securely attach the message holder to the keyhole of a door lock, or in the alternative, to the door body of the door lock, and a message board attached to the holder head having an erasable writing surface. The means to attach the message holder to the door lock keyhole comprises a keyhole pin which extends from a side of the holder head body having a magnetic disk disposed about the keyhole pin and fixedly attached to the holder head body. The means to attach the message holder to the door lock body comprises an adhesive film having a removable film liner. The writing surface of the message board is preferably dry-erasable.

The primary object of the present invention is to provide means for leaving a written message- at a conspicuous location.

It is also an object of this invention to provide means for leaving a written message in a secured manner.

A further object of the present invention is to provide means for leaving a written message that can be attached to a door lock, and particularly to a key-operated door lock.

These and other objects and advantages of the door lock message holder of the present invention will be apparent to those skilled in the art from the following description of a preferred embodiment, claims and appended drawings.

DESCRIPTION OF A PREFERRED EMBODIMENT

Figure 1:
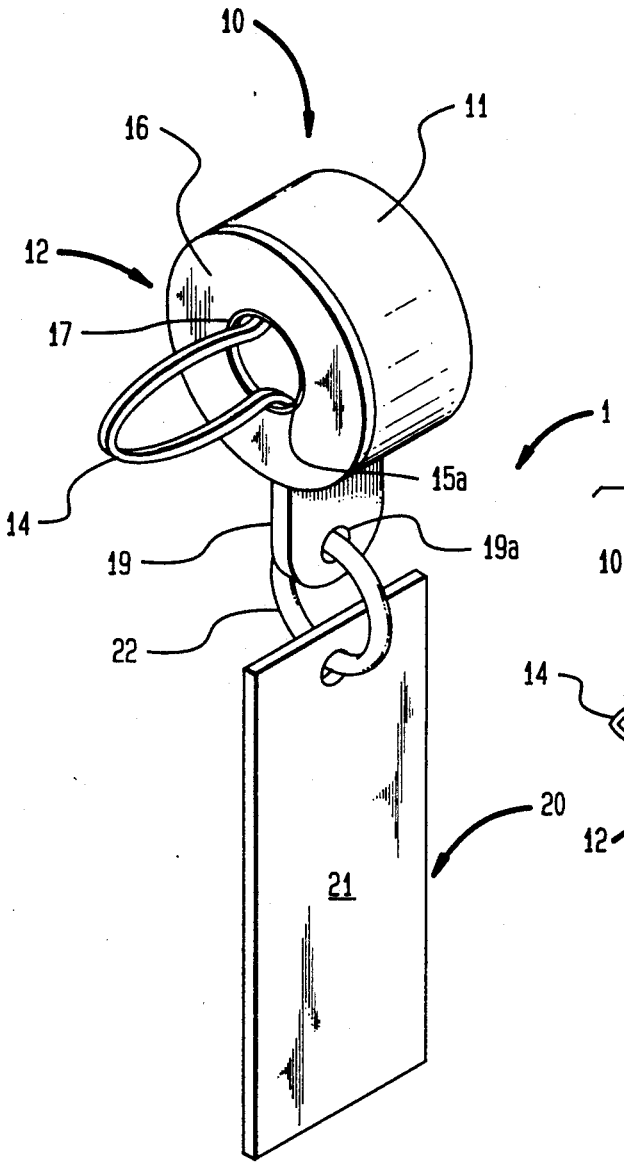
FIG. 1 is a perspective view of the door lock message holder of the present invention.
Figure 2:
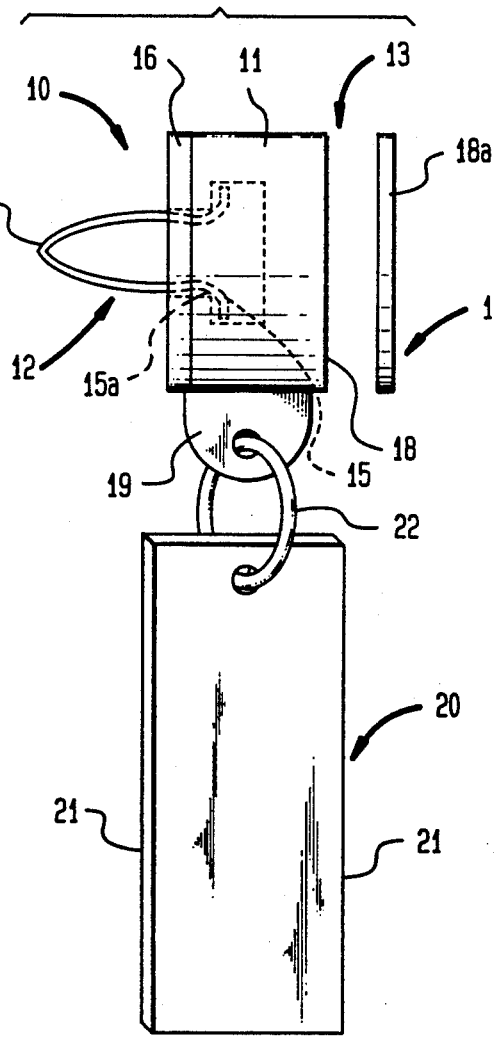
FIG. 2 is a side plan view of the door lock message holder.

FIG. 1 illustrates in a perspective view the door lock message holder 1 of the present invention. The message holder 1 generally comprises a holder head 10 having alternative means of attaching the message holder 1 to a door lock as hereinafter described in greater detail, and a message board 20 attached to the holder head 10. Holder head 10 includes a holder head body 11 substantially comprising a cylindrical body, having door lock keyhole attachment means 12 attached to one end of said holder head body 11 and door lock body attachment means 13 (FIG. 2) attached to the opposite end of the holder head body 11. Door lock keyhole attachment means 12 includes a keyhole pin 14, preferably formed from break-resistant nylon, which extends from the holder head body 11 and is fixedly attached thereto. In the preferred embodiment of the message holder 1, holder head body 11 is formed having a holder head body slot 15 (FIG. 2) which communicates with an end of said holder head body 11 via a slot opening 15*a* and keyhole pin 14 comprises a length of marginally-stiff material, formed in the shape of the capital Greek alphabet omega, the ends thereof being received in the holder head body slot 15. Slot opening 15*a* is formed having a smaller diameter than the diameter of the holder head body slot 15 so that the ends of the keyhole pin 14 are held within said holder head body slot 15 by bearing engagement with the portion of said holder head body 11 disposed about said slot opening 15*a*. Holder head body slot 15 is sufficiently deep to permit the ends of said keyhole pin 14 to move longitudinally within said slot 15 when the extending end of the keyhole pin 14 is compressed. Keyhole pin 14 may alternatively be a straight extending member. A magnetic disk 16 having a disk opening 17 is disposed about said keyhole pin 14 and fixedly attached to said holder head body 11. As can be seen in FIG. 2, an adhesive film 18 is disposed on the opposite end of the holder head body 11, the adhesive film 18 having a selectively removable film liner 18*a* disposed thereon. A message board attachment tab 19 extends from the side of said holder head body 11 having a tab opening 19*a* formed therein.

Message board 20 has one or a plurality of writing surfaces 21 and is fixedly attached to said holder 10 by a message board attachment ring 22 which engages the tab opening 19*a* of said message board attachment tab 19. The writing surface 21 of said message board 20 is preferably dry-erasable. In the alternative the message board 20 may be formed having a permanently printed message in lieu of the dry-erasable writing surface 21.

Figure 3:
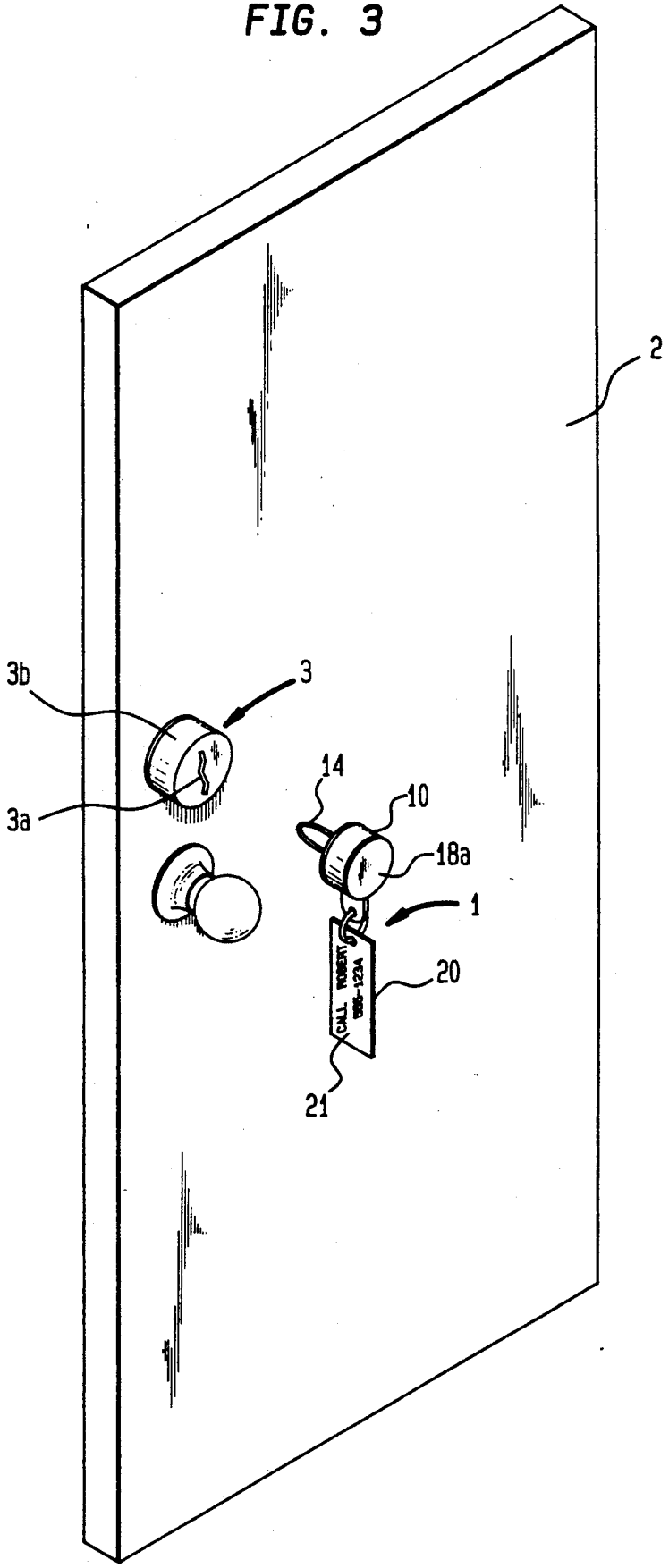
FIG. 3 is a perspective view of the present invention illustrating its attachment to a key-operated door lock.

FIG. 3 illustrates how the message holder 1 of the present invention is utilized which may be understood from its construction but is presented herein for clarity. When it is desired to leave a written message at an apartment door 2, for example, the message is written on the writing surface 21 of the message board 20 and the message holder 1 is secured to the door lock 3 by inserting the keyhole pin 14 into the keyhole 3*a* of the door lock 3. The holder head 10 is moved toward the door lock 3 to bring the magnetic disk 16 adjacent to the door lock body 3*b* and thereby further secure the message holder 1 to the door lock 3 by magnetic attraction between the door lock body 3*b* and the magnetic disk 16. Alternately, the message holder 1 may be affixed to the door lock body 3*b* by removing the adhesive liner 18*a* and affixing the message holder 1 to the door lock body 3*b* by adherence of the adhesive film 18 thereto.

Various changes and modifications may be made to the door lock message holder 1 of the present invention without departing from the spirit and scope of this disclosure. Such changes and modifications are intended as part of the present invention as held in the following claims.

Therefore, in view of the foregoing I claim:

1. A door lock message holder having door lock keyhole attachment means and door lock body attachment means, a holder head including a holder head body substantially comprising a cylindrical body having a holder head body slot communicating with an end of said holder head body via a slot opening, said slot opening having a smaller diameter than a diameter of said holder head body slot, said door lock keyhole attachment means comprising a keyhole pin extending from the holder head body and attached to said holder head body slot and a magnetic disk disposed about said keyhole pin and fixedly attached to said holder head body; and a message board attached to said holder head.

2. A door lock message holder as in claim 1 wherein said keyhole pin comprises a length of marginally-stiff material formed in a shape of a capital Greek letter omega, ends of said length of material being received in the holder head body slot and held attached to said holder head body by bearing engagement of ends of said length of material with a portion of said holder head disposed about said slot opening.

3. A door lock message holder as in claim 2 wherein said length of material comprises break-resistant nylon.

4. A door lock message holder as in claim 3 wherein said door lock body attachment means comprises an adhesive film disposed on the opposite end of said holder head body.

5. A door lock message holder as in claim 4 further including a film liner disposed on the adhesive film.

* * * * *